US007620334B2

(12) United States Patent
Shimizu

(10) Patent No.: US 7,620,334 B2
(45) Date of Patent: Nov. 17, 2009

(54) IMAGE FORMING APPARATUS HAVING DISABLEMENT OF IMAGE FORMATION BASED ON DETECTION OF DEVELOPER

(75) Inventor: Akihiro Shimizu, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 553 days.

(21) Appl. No.: 11/460,917

(22) Filed: Jul. 28, 2006

(65) Prior Publication Data

US 2007/0047977 A1 Mar. 1, 2007

(30) Foreign Application Priority Data

Aug. 31, 2005 (JP) ..... 2005-251657

(51) Int. Cl.
*G03G 15/08* (2006.01)

(52) U.S. Cl. ..... 399/30; 399/61; 399/258

(58) Field of Classification Search ..... 399/13, 399/27, 30, 61–64, 258
See application file for complete search history.

(56) References Cited

U.S. PATENT DOCUMENTS

| | | | | | |
|---|---|---|---|---|---|
| 4,977,429 | A | * | 12/1990 | Tani et al. | 399/27 |
| 5,182,600 | A | * | 1/1993 | Hasegawa et al. | 399/74 |
| 5,398,106 | A | * | 3/1995 | Eguchi | 399/110 |
| 5,754,916 | A | * | 5/1998 | Kitayama et al. | 399/27 |
| 6,763,198 | B2 | * | 7/2004 | Matsumoto | 399/13 |
| 6,931,217 | B2 | * | 8/2005 | Akashi et al. | 399/27 |
| 7,206,528 | B2 | * | 4/2007 | Matsunai | 399/43 |
| 7,376,362 | B2 | * | 5/2008 | Kajikawa | 399/12 |

FOREIGN PATENT DOCUMENTS

| | | | | |
|---|---|---|---|---|
| JP | 62080670 | A | * | 4/1987 |
| JP | 63008767 | A | * | 1/1988 |
| JP | 05181364 | A | * | 7/1993 |
| JP | 07028322 | A | * | 1/1995 |
| JP | 10-020648 | A | | 1/1998 |
| JP | 2000029372 | A | * | 1/2000 |
| JP | 2000310903 | A | * | 11/2000 |
| JP | 2001265104 | A | * | 9/2001 |
| JP | 2001305845 | A | * | 11/2001 |
| JP | 2005043510 | A | * | 2/2005 |

* cited by examiner

*Primary Examiner*—Robert Beatty
(74) *Attorney, Agent, or Firm*—Canon U.S.A., Inc. IP Division

(57) ABSTRACT

An image forming apparatus includes a developing device configured to develop an electrostatic image on an image carrier with developer, and a developer container detachably attachable to the image forming apparatus and configured to store developer to be supplied to the developing device. A developer supply unit is configured to supply the developer from the developer container to the developing device. The developer supply unit includes a developer detector configured to detect the amount of developer in the developer supply unit. The image forming apparatus controls the supply of developer transported via the developer supply unit and disables image formation on the basis of the detection result obtained from the developer detector. After the image formation is disabled, when the completion of the replacement of the developer container is detected, the image forming apparatus canceled the disabled image formation regardless of the detection result obtained from the developer detector.

14 Claims, 9 Drawing Sheets

IMAGE FORMING APPARATUS HAVING DISABLEMENT OF IMAGE FORMATION BASED ON DETECTION OF DEVELOPER

BACKGROUND OF THE INVENTION

1. Field of the Invention

The present invention relates to image forming apparatuses, such as copiers, facsimiles, and printers, and more particularly, to a system and method associated with supplying of developer (e.g., toner) from a developer container to a developing device and replacement of developer containers.

2. Description of the Related Art

A known image forming apparatus includes a photosensitive member serving as a latent image carrier, on which an electrostatic latent image is formed by, for example, a charging device and an exposure device. The electrostatic latent image is developed with developer (developing agent such as, for example, toner), by a developing device, into a visible image.

The visible image is transferred by a transfer device onto a transfer medium (recording medium) supplied from a paper feed cassette, through a paper feed roller and a transport roller, to the photosensitive member. The transfer medium on which the visible image has been transferred is transported by a transport device to a fixing device, where the visible image is subjected to heat and pressure, causing a permanent image to be fixed onto the transfer medium. Then, the transfer medium bearing the permanent image is ejected from the image forming apparatus as a final copy.

The developing device includes a developing sleeve which causes developer to adhere to an electrostatic latent image formed on the photosensitive member, and a developing container in which developer is held. A developer storage device (hereinafter simply referred to as "storage device") serves as developer storage from which developer is supplied to the developing container.

A bottle (i.e., developer container) attachable to and detachable from the storage device is placed above the storage device such that developer is supplied to the storage device.

FIG. 8 illustrates an exemplary configuration of a bottle, a storage device, and their neighboring components included in an image forming apparatus. FIG. 9 is a cross-sectional view as viewed in the direction of arrow B in FIG. 8. Referring to FIG. 8 and FIG. 9, developer is supplied from a bottle 1 to a storage device 2 through a connecting part (i.e., supply port) 1*b* located at an end of the length of the storage device 2 and serving as a communicating part. From the storage device 2, developer is supplied across the entire length of the developing device 105. Thus, the bottle 1 and the storage device 2 combine to serve as a supply system for supplying developer to the developing device 105.

The above-described configuration in which developer is supplied from an end of the length of the storage device 2 may cause an uneven distribution of the developer along the length of the storage device 2. Therefore, as illustrated in FIG. 9, a developer evening mechanism 5 serving as an agitator is provided inside the storage device 2 so that the developer from the storage device 2 is supplied across the entire length of the developing device 105. This ensures an even distribution of the developer across the entire length of the developing device 105, and thus can prevent image defects.

Moreover, the storage device 2 further includes a first developer detector 7*a*, such as a piezoelectric sensor, so as to prevent an excessive supply of developer from the bottle 1 to the storage device 2.

Specifically, when the amount of developer in the storage device 2 decreases, the output of the first developer detector 7*a* changes. On the basis of this output, a transport mechanism 4 in the bottle 1 is driven to cause developer to be discharged from an outlet of the bottle 1. When the amount of developer in the storage device 2 increases and the output of the first developer detector 7*a* changes again, the drive of the transport mechanism 4 is stopped. The amount of developer in the storage device 2 thus remains constant.

The storage device 2 also includes a second developer detector 7*b* to ensure, when the amount of developer in the second storage device 2 is extremely reduced, the capability of transporting developer to the developing device 105 while maintaining an even distribution of the developer across the entire length of the second storage device 2.

In the known image forming apparatus including the developing device 105 and the supply system described above, when the first developer detector 7*a* detects the absence of developer for a predetermined period of time, a message "Replace the bottle" is displayed on the user control screen (not shown) to inform the user that no developer is left in the bottle 1.

In the supply system having the above-described configuration (discussed in Japanese Patent Laid-Open No. 10-20648), even if the above-described message is displayed on the user control screen, it is still possible to continue the ongoing image formation until the second developer detector 7*b* determines that no developer is left. When the second developer detector 7*b* detects the absence of developer for a predetermined period of time, the image forming apparatus terminates (disables) the image formation on the basis of the determination that an insufficient amount of developer remains in the bottle 1 and the storage device 2.

Under the state in which the second developer detector 7*b* detects the absence of developer, it is difficult to supply developer from the storage device 2 to the developing device 105 in a manner to maintain an even distribution of the developer across the length of the developing device 105. Therefore, after the user replaces the bottle 1 with the new one, a certain period of time for supplying developer from the bottle 1 (i.e., supply operation checking time) is required until the second developer detector 7*b* detects that the developer is present in the second storage device 2. The initiation of image formation is disabled until the second developer detector 7*b* detects the presence of developer.

Recently, image forming apparatuses, such as copiers and printers, are expected to perform image formation at higher speeds. This involves a demand for improved productivity that can be achieved by minimizing the time required for supplying developer and paper, performing maintenance operations, and the like.

In a known image forming apparatus, such as that described above, when developer runs out and the image forming operation is stopped, a certain period of time (supply operation checking time) elapses from when the user replaces a bottle (developer container) with the new one until the operation of the image forming apparatus is resumed. Since a high-speed image forming apparatus may require more frequent replacement of the bottle, the time during which the image forming apparatus is stopped may increase and adversely affect the productivity.

SUMMARY OF THE INVENTION

Embodiments of the present invention have been provided in view of the problems described above, and provide an image forming apparatus that can increase productivity by eliminating or at least reducing an amount of waiting time associated with a replacement of the developer container.

According to an aspect of the present invention, an image forming apparatus includes a developing device configured to develop an electrostatic image on an image carrier with developer, and a developer container attachable to and detachable from the image forming apparatus and configured to store developer to be supplied to the developing device. A developer supply unit is configured to transport the developer from the developer container to the developing device. A developer detector is configured to detect an amount of developer in the developer supply unit. A supply controller is configured to control transportation of developer via the developer supply unit on the basis of a detection result obtained from the developer detector. The image forming apparatus further includes a disabling device configured to disable image formation on the basis of the detection result obtained from the developer detector, and a container replacement detector configured to detect a replacement of the developer container. The image forming apparatus is configured to cancel, after the disabling device disables the image formation, the disabled image formation when the container replacement detector detects the completion of the replacement of the developer container, regardless of the detection result obtained from the developer detector.

Further features of the present invention will become apparent from the following description of exemplary embodiments with reference to the attached drawings.

DESCRIPTION OF THE EMBODIMENTS

Exemplary embodiments of the present invention will now be described in detail with reference to the drawings. The dimensions, materials, shapes, control methods, relative configuration of components, and other specific details described in the following embodiments are not intended to limit the scope of the present invention unless otherwise specified.

An image forming apparatus according to the exemplary embodiments of the present invention will now be described with reference to FIG. 1 to FIG. 7.

Figure 1:
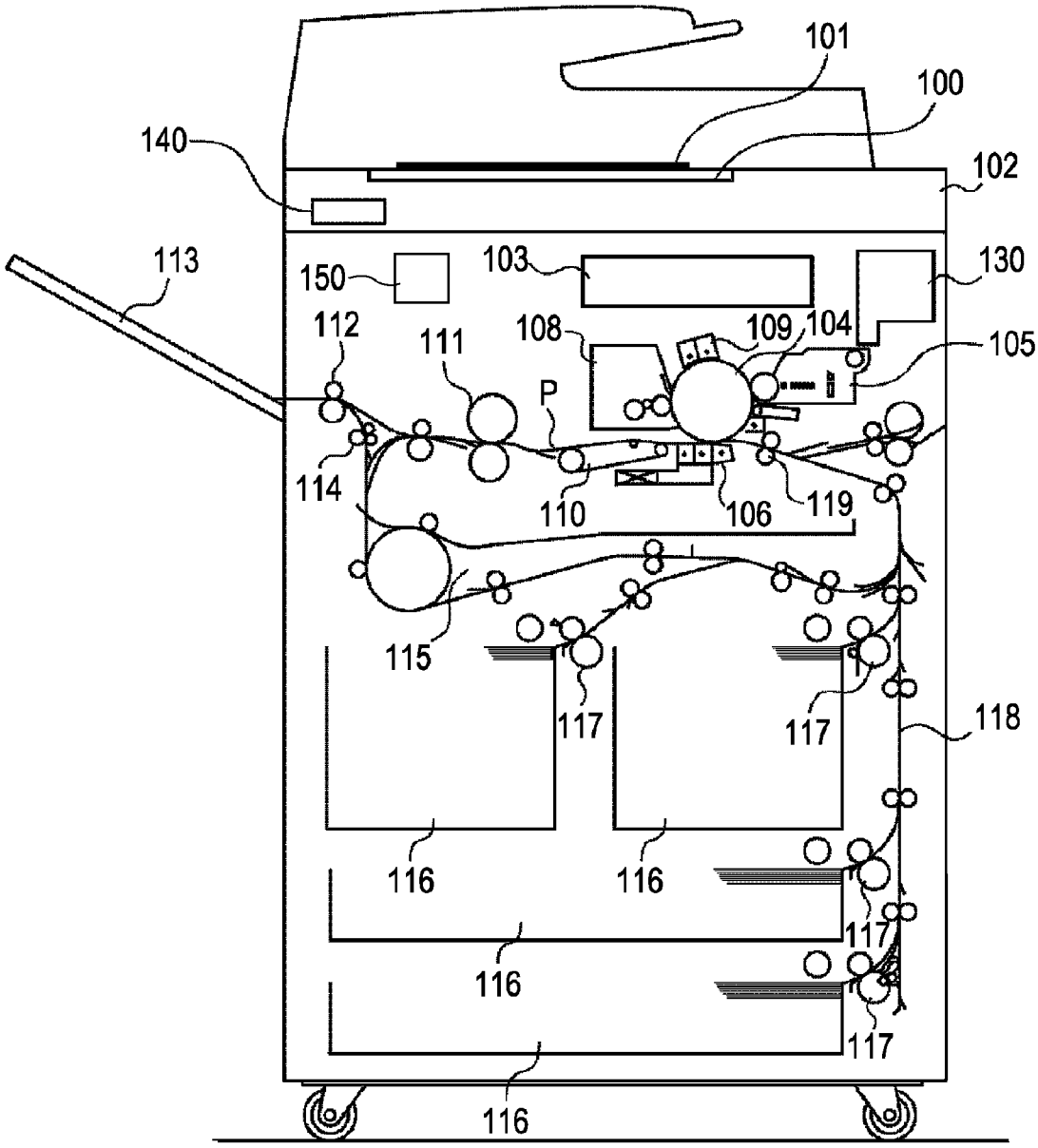
FIG. 1 is a vertical cross-sectional view of an image forming apparatus according to exemplary embodiments of the present invention.
Figure 2:
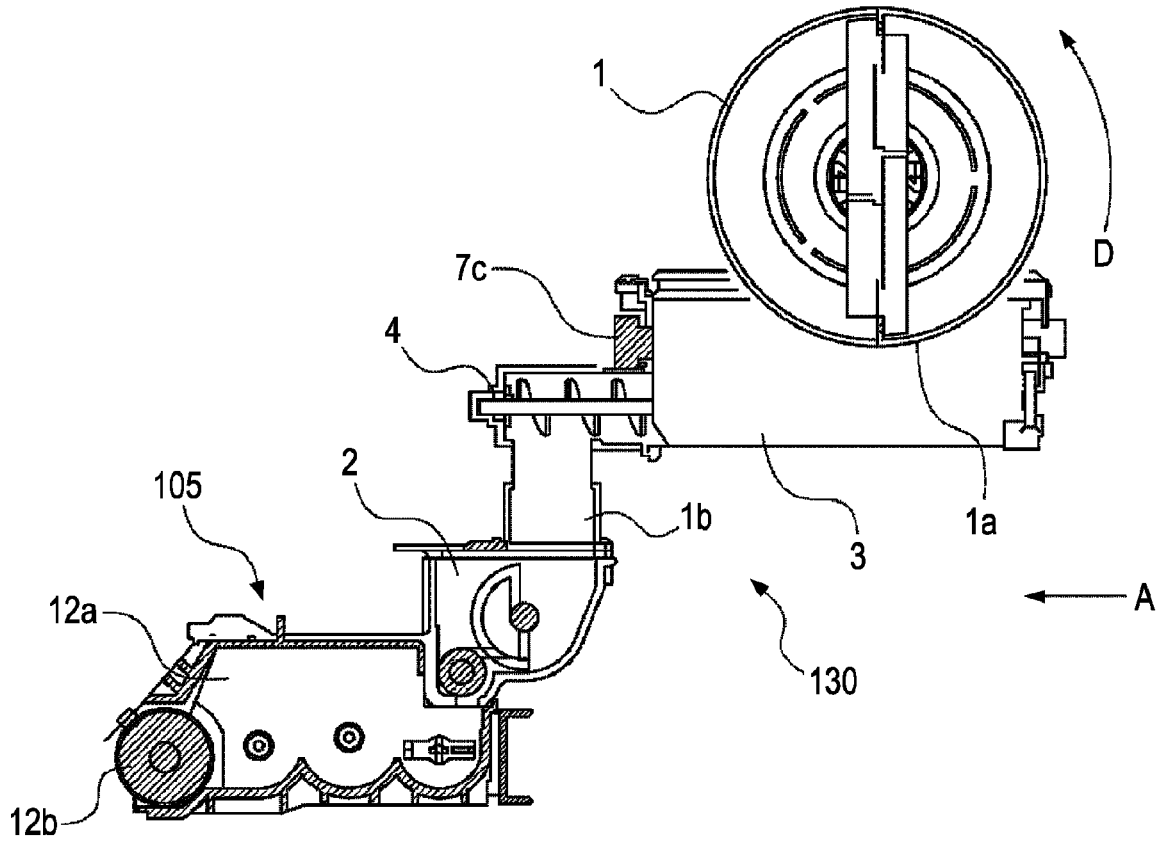
FIG. 2 is a vertical cross-sectional view illustrating a supply system and a developing device according to the exemplary embodiments of the present invention.
Figure 3:
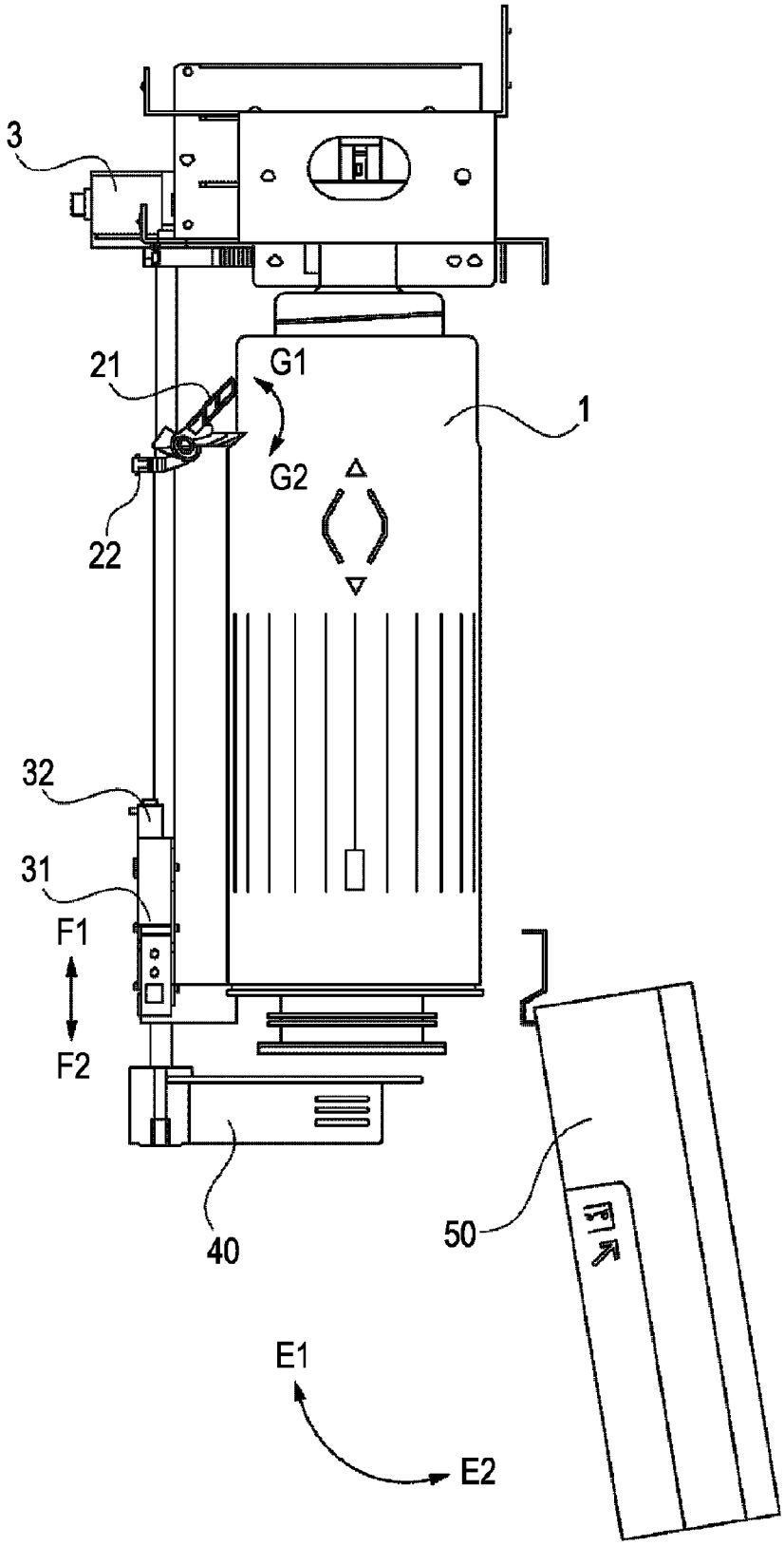
FIG. 3 is a top plan view of the supply system according to the exemplary embodiments of the present invention.
Figure 4:
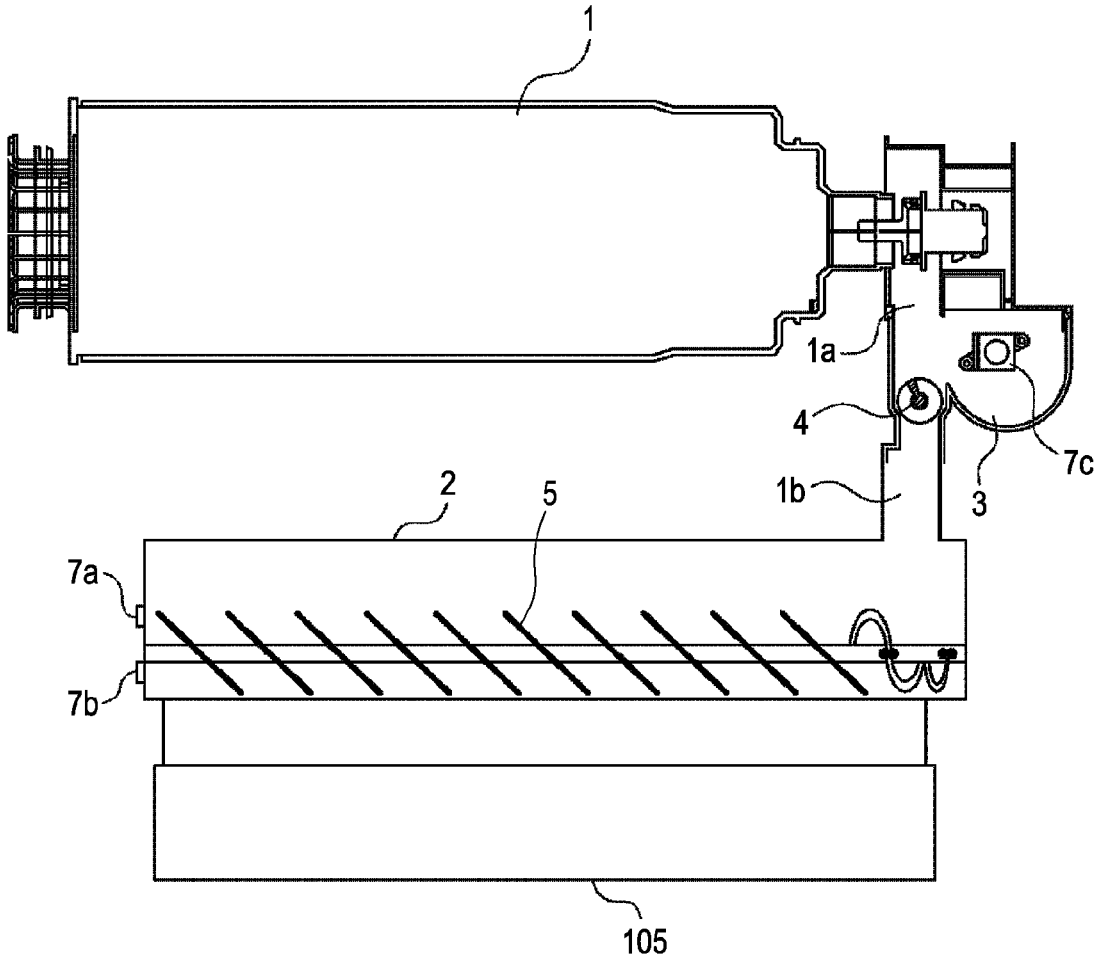
FIG. 4 is a horizontal cross-sectional view illustrating the supply system and the developing device according to the exemplary embodiments of the present invention.

FIG. 1 is a schematic cross-sectional view of an image forming apparatus according to the exemplary embodiments of the present invention. FIG. 2 is an enlarged schematic cross-sectional view illustrating a supply system and a developing device of the image forming apparatus in FIG. 1. FIG. 3 is a schematic top plan view illustrating the supply system of the image forming apparatus in FIG. 1. FIG. 4 is a schematic horizontal cross-sectional view taken along arrow A in FIG. 2.

Referring to FIG. 1, a document 101 is placed on a document glass table 100. A reader unit 102 transports the document 101 to read image information of the document 101.

An optical unit 103 serves as an exposure unit which causes a specific point on the surface of a drum 104 (i.e., image carrier) to be exposed to light containing image information of the document 101 or other image information.

The optical unit 103 includes a laser light source which causes image information obtained by the reader unit 102 or other image information to blink according to electric signals processed and controlled by an image processor (not shown). A plurality of optical components are provided on an optical path for guiding a laser beam from the laser light source to the drum 104. Examples of the optical components include a plurality of mirrors for reflecting a laser beam, and a plurality of optical members (various types of lenses) for optical magnification or correction.

A developing device 105 and a supply system 130 are disposed near the drum 104. The developing device 105 supplies developer (e.g., toner) to the drum 104 for visualizing an electrostatic latent image on the drum 104. The supply system 130 supplies toner to the developing device 105. A transfer/charge separation device 106 is also disposed near the drum 104. The transfer/charge separation device 106 transfers a toner image to a sheet P, and has a separator for removing, from the drum 104, the sheet P electrostatically attracted to the drum 104. A cleaning device 108 removes toner remaining on the drum 104 without being transferred to the sheet P. A charging device 109 charges the surface of the drum 104 to a predetermined potential.

A transport device 110 transports, from the drum 104 to a fixing device 111, the sheet P on which a toner image has been transferred. A paper ejection/inversion device 114 controls whether the sheet P from the fixing device 111 is to be ejected through a paper-ejection roller assembly 112 onto a paper ejection tray 113, or to a paper refeed device 115 for feeding the sheet P to the drum 104 again for double-sided or overlay copying. Sheets are stacked and stored in paper feed cassettes 116.

Next, the operation of the image forming apparatus having the above-described configuration will be sequentially described.

When the user presses a copy start button (not shown), sheets stacked in one of the paper feed cassettes 116 are transported individually by a paper feed device 117 through a vertical transport path 118 to a register roller assembly 119.

Subsequently, the reader unit 102 starts scanning the document 101 to convert image information thereof into electric signals. The optical unit 103 applies light containing image information of the document 101, through the image processor (not shown), to the surface of the drum 104 such that the image is recorded. This operation may be performed on the basis of image information input from external devices. In synchronization with this operation, the register roller assembly 119 starts transporting a sheet P.

At this point, an electrostatic latent image corresponding to image information of the document 101, the image information being recorded on the drum 104, is converted by the developing device 105 into a toner image, which is transferred by the transfer/charge separation device 106 onto the sheet P. Then, the sheet P is separated by the transfer/charge separation device 106 from the drum 104 and transported by the transport device 110 to the fixing device 111, where the toner image is fixed to the sheet P. For single-sided copying, the sheet P is transported by the paper ejection/inversion device 114 through the paper-ejection roller assembly 112 onto the paper ejection tray 113.

For double-sided or overlay copying, the sheet P on which the toner image has been fixed by the fixing device 111 is transported by the paper ejection/inversion device 114 to the paper refeed device 115 and further to the drum 104, where another toner image is transferred to the sheet P. Then, the sheet P is sequentially transported through the transport device 110, the fixing device 111, the paper ejection/inversion device 114, and the paper-ejection roller assembly 112 and ejected onto the paper ejection tray 113.

Next, components disposed in and around the developing device 105 and supply system 130 of the above image forming apparatus will be described with reference to the drawings. FIG. 2 is a schematic cross-sectional view illustrating the developing device 105 and the supply system 130 including a bottle 1, a first storage device 3, and a second storage device 2 in detail. FIG. 3 is an overhead view of the components illustrated in FIG. 2. FIG. 4 is a cross-sectional view taken along arrow A in FIG. 2.

As illustrated in FIG. 2, the developing device 105 includes a developing sleeve 12*b* serving as a developer carrier that causes developer to adhere to an electrostatic latent image formed on the drum 104, and a developing container 12*a* in which developer is held. The second storage device 2 serves as developer storage and supplies developer to the developing container 12*a*.

The first storage device 3 serving as developer storage is disposed above the second storage device 2 and supplies developer to the second storage device 2. The bottle 1 above the first storage device 3 is attachable to and detachable from the first storage device 3. The bottle 1 serves as a developer container, from which developer is supplied to the first storage device 3.

As illustrated in FIG. 3, a bottle detecting unit (including a bottle sensing lever 21 and a bottle sensor 22) and a door open/close detecting unit (including a door open/close sensing member 31 and a door open/close sensor 32) are disposed near the space for accommodating the bottle 1. The bottle detecting unit (21 and 22) determines whether the bottle 1 is in place. The door open/close detecting unit (31 and 32) determines whether the door 50 for the user to access the bottle 1 is opened or closed.

The user's operation for attaching the bottle 1 to the image forming apparatus will be described with reference to FIG. 3. The user inserts the bottle 1, in the direction of arrow F1, into the image forming apparatus by using an operating part 40. The bottle sensing lever 21 is pressed by the inserted bottle 1, rotated in the direction of arrow G1, and brought into contact with the outer surface of the bottle 1. When the movement of the bottle sensing lever 21 is detected by the bottle sensor 22, the image forming apparatus recognizes that the bottle 1 is placed in the supply system 130. Subsequently, when the door 50 is closed in the direction of arrow E1, the door open/close sensing member 31 is pressed by part of the door 50. When the door 50 is completely closed, the door open/close sensor 32 detects it. For the removal of the bottle 1 from the image forming apparatus, the user follows the above-described steps in the reverse order.

The image forming apparatus goes through the following steps to recognize that the bottle 1 has been replaced with a new one. First, the door open/close detecting unit (31 and 32) detects that the door 50 has been opened in the direction of arrow E2. Next, the bottle detecting unit (21 and 22) detects that the bottle 1 has been removed, in the direction of arrow F2, from the image forming apparatus. Subsequently, the bottle detecting unit (21 and 22) detects that the bottle 1 has been attached to the image forming apparatus. Then, the door open/close detecting unit (31 and 32) detects that the door 50 has been closed. The image forming apparatus thus recognizes that the user has replaced the bottle 1 with the new one, according to the series of detection steps described above.

Next, supply operations from the bottle 1 to the first storage device 3, and from the first storage device 3 to the second storage device 2 will be described with reference to FIG. 2 and FIG. 4.

Developer is supplied from the bottle 1 to the first storage device 3 through a connecting path 1*a*, which serves as a communicating part between the bottle 1 and the first storage device 3. Likewise, developer is supplied from the first storage device 3 to the second storage device 2 through a connecting path 1*b* provided at an end of the length of the second storage device 2 and serving as a communicating part. Developer is supplied from the second storage device 2 to the developing container 12*a* such that the developer is distributed across the entire length of the developing container 12*a*.

The bottle 1 is driven by a drive unit (not shown) and rotated in the direction of arrow D in FIG. 2. This allows developer in the bottle 1 to be supplied to the first storage device 3. The developer supplied to the first storage device 3 is further supplied to the second storage device 2 by a transport mechanism 4, such as a screw, in the first storage device 3.

The above-described configuration, illustrated in FIG. 4, in which developer is supplied from an end of the length of the second storage device 2 may cause an uneven distribution of the developer along the length of the second storage device 2. Therefore, a developer evening mechanism 5 serving as an agitator is provided inside the second storage device 2 so that the developer from the second storage device 2 is supplied across the entire length of the developing container 12*a*. This ensures an even distribution of the developer across the entire length of the developing container 12*a*, and thus can prevent image defects.

The first storage device 3, the second storage device 2, and other components configured to transport developer and disposed in the first and second storage devices 3 and 2 combine to serve as a developer supply unit. The operation of the developer supply unit is controlled by a supply controller in a control section 150 illustrated in FIG. 1.

Next, detectors for detecting developer in the first and second storage devices 3 and 2 will be described.

As illustrated in FIG. 4, the first storage device 3 includes a developer detector 7*c*, such as a piezoelectric sensor, so as to prevent an excessive supply of developer from the bottle 1 to the first storage device 3.

Likewise, the second storage device 2 includes a developer detector 7*a*, such as a piezoelectric sensor, so as to prevent an excessive supply of developer from the first storage device 3 to the second storage device 2.

Specifically, when the amount of developer in the first storage device 3 decreases, the output of the developer detector 7*c* changes. On the basis of this output, the drive unit (not shown) drives the bottle 1 to cause developer to be discharged from an outlet of the connecting path 1*a*. When the amount of developer in the first storage device 3 increases and the output of the developer detector 7*c* changes again, the drive unit described above is stopped. The amount of developer in the first storage device 3 thus remains constant.

Likewise, when the amount of developer in the second storage device 2 decreases, the output of the developer detector 7*a* changes. On the basis of this output, the transport mechanism 4 in the first storage device 3 is driven to cause developer to be discharged from an outlet of the first storage device 3. When the amount of developer in the second storage device 2 increases and the output of the developer detector 7*a* changes again, the drive of the transport mechanism 4 is stopped. Thus, the amount of developer in the second storage device 2 can remain within a desired range by controlling transportation of developer from the first storage device 3 to the second storage device 2 based on the output of the developer detector 7*a*.

In addition, as illustrated in FIG. 4, in the second storage device 2, the developer detectors 7*a* and 7*b* are attached to one end that is opposite the other end to which developer is supplied from the first storage device 3. Therefore, developer can be evenly distributed across the length of the second storage device 2 at least during a certain period immediately after being supplied from the first storage device 3.

Moreover, the developer detector 7*b* is positioned with respect to the second storage device 2 such that developer from the second storage device 2 is evenly distributed across the length of the developing device 105 as long as the developer detector 7*b* detects the presence of developer.

Next, in the present exemplary embodiment illustrated in FIG. 2 to FIG. 4, the operation of the second storage device 2, first storage device 3, bottle 1, and image forming apparatus when the bottle 1 has an insufficient amount of developer will be described in relation to the replacement of the bottle 1 by the user, with reference to the flowcharts in FIG. 5 and FIG. 6.

Figure 5:
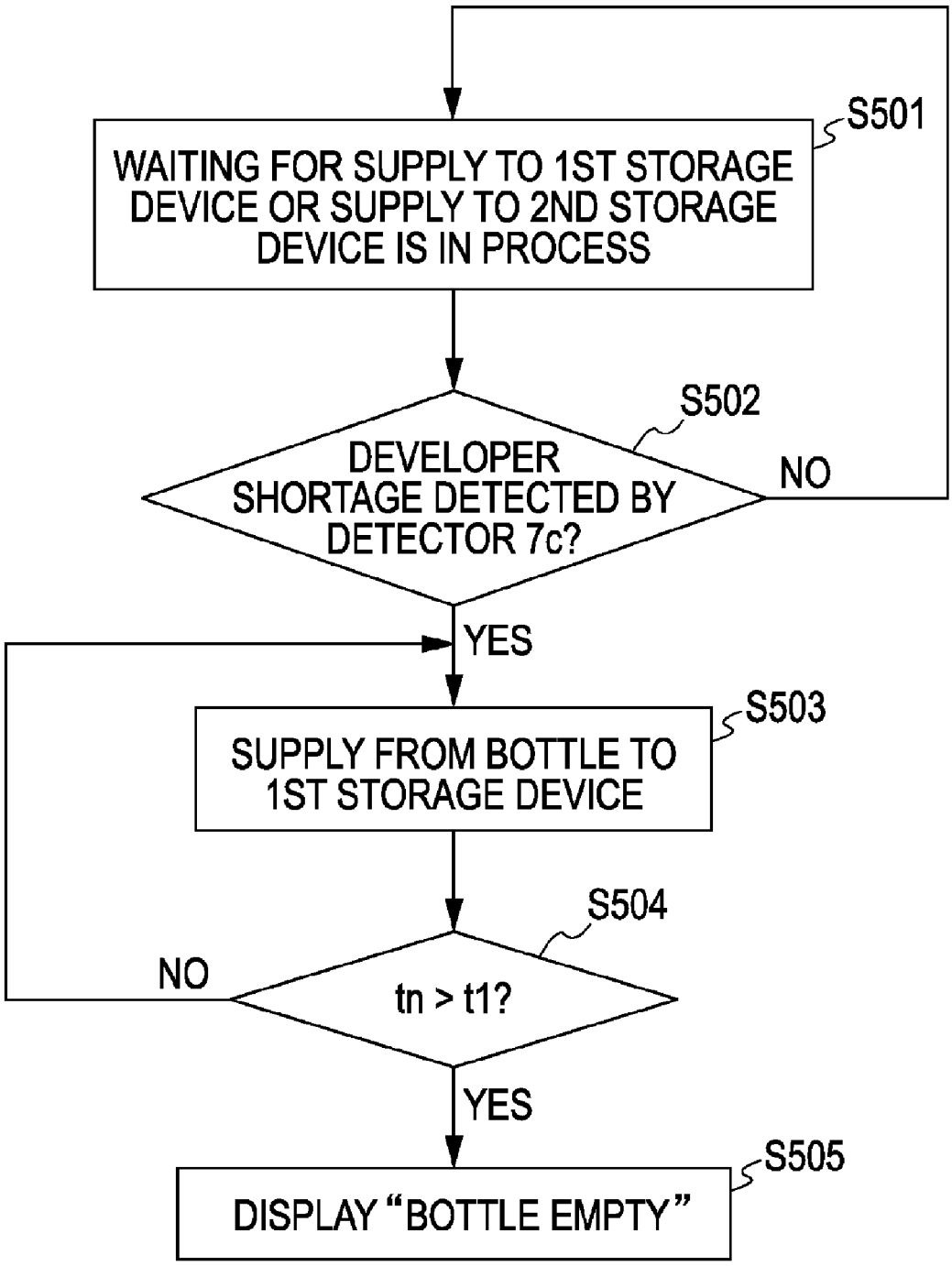
FIG. 5 is a flowchart illustrating exemplary supply control of the supply system according to the exemplary embodiments of the present invention.

The supply of developer from the bottle 1 to the first storage device 3 illustrated in FIG. 5 takes place regardless of whether the image forming apparatus is in operation. When developer is supplied from the first storage device 3 to the second storage device 2 (step S501) and the amount of developer in the first storage device 3 decreases, the developer detector 7*c* detects the decrease (step S502). In response, developer is supplied from the bottle 1 to the first storage device 3 (step S503). Next, a time period "tn" during which the developer detector 7*c* detects the absence of developer is measured (step S504). If the measured time period "tn" exceeds a predetermined time period "t1" (i.e., if Timeout 1 occurs), the image forming apparatus determines that developer is no longer being supplied from the bottle 1 to the first storage device 3. Then, the image forming apparatus displays a message "Replace the bottle" or "Bottle empty" in an operating unit (informing unit) 140 illustrated in FIG. 1 to the user (step S505). The image forming apparatus can operate until developer remaining in the storage devices 3, 2 between the developer detector 7*c* and the developer detector 7*a* is exhausted. In other words, it is possible to carry out image formation during the period from when the developer detector 7*c* detects the absence of toner until about when the developer detector 7*a* detects the absence of toner.

Figure 6:
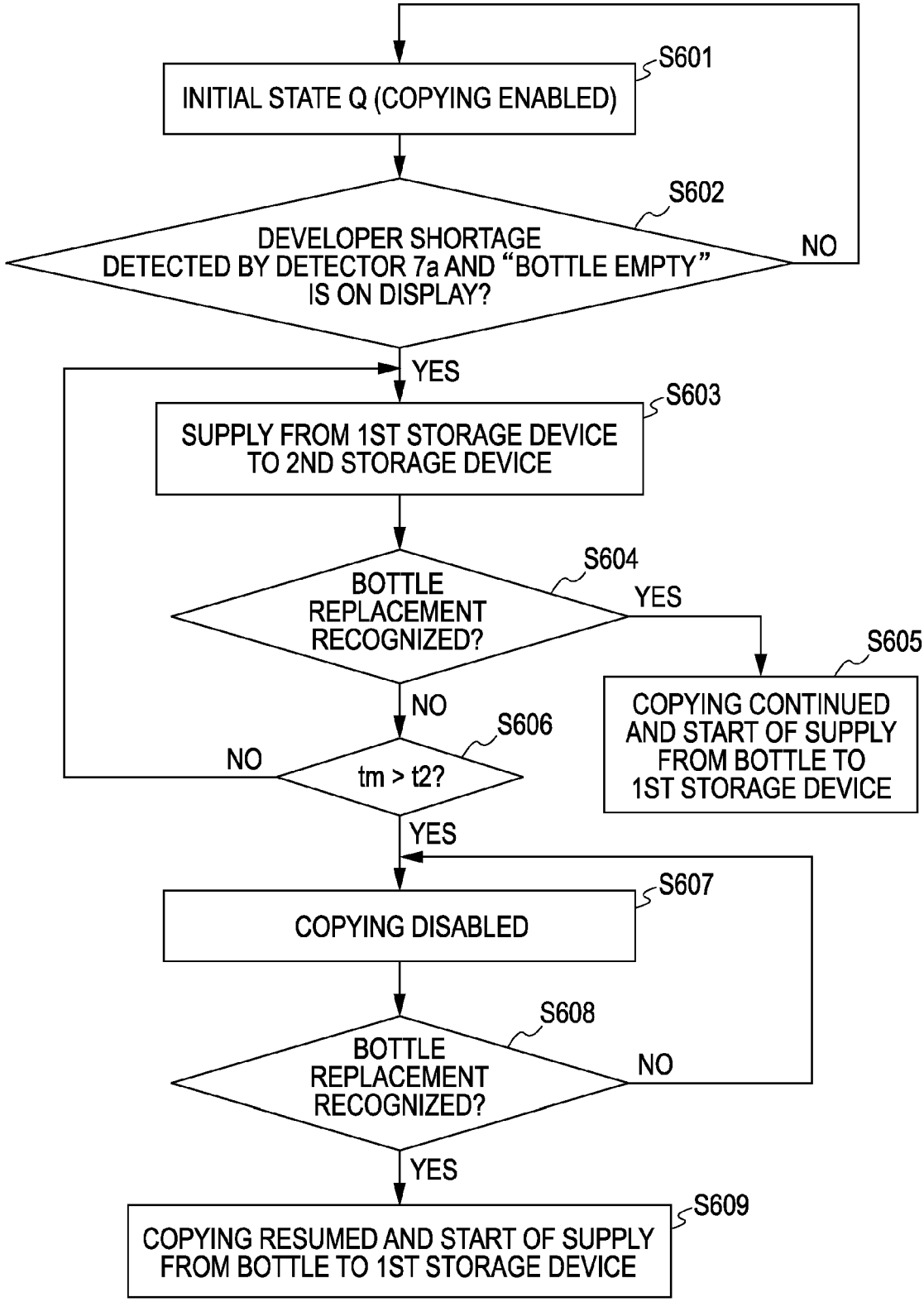
FIG. 6 is another flowchart illustrating exemplary supply control of the supply system according to the exemplary embodiments of the present invention.

Referring to FIG. 6, subsequent to the initial state "Q" (step S601), if the developer detector 7*a* detects the shortage of developer while the message "Bottle empty" is displayed (step S602), developer is supplied from the first storage device 3 to the second storage device 2 (step S603). If the bottle 1 is replaced with the new one before developer remaining in the storage devices 3, 2 between the developer detector 7*c* and the developer detector 7*a* is exhausted ("Yes" in step S604), the image forming apparatus continues operating and developer is transported from the bottle 1 to the first storage device 3 (step S605).

On the other hand, if the bottle 1 is not replaced with the new one before developer remaining in the storage devices 3, 2 between the developer detector 7*c* and the developer 7*a* is exhausted ("No" in step S604), and if the developer detector 7*a* in the second storage device 2 detects that a time period "tm" during which the developer detector 7*a* detects the absence of developer has exceeded a predetermined time period "t2" (i.e., if Timeout 2 occurs) ("Yes" in step S606), the image forming apparatus causes a disabling device in the control section 150 to disable the copying operation (step S607). Then, the image forming apparatus enters a wait state where it waits for the replacement of the bottle 1 by the user.

After which, if the bottle 1 has been replaced with the new one by the user (step S608), the image forming apparatus will receive, from the bottle detecting unit (21 and 22) and door open/close detecting unit (31 and 32), signals indicating that the replacement of the bottle 1 has been completed. In response to the recognition that the bottle 1 has been replaced, the image forming apparatus immediately resumes the image formation regardless of the detection result obtained from the developer detectors 7*a*, 7*b*, and 7*c* (step S609). The image formation is resumed when a canceling device in the control section 150 cancels the disabled state. At the same time, the drive unit (not shown) drives the bottle 1 to initiate the supply of developer to the first storage device 3 (i.e., to initiate operation for recovery to the initial state "Q").

After the bottle 1 is replaced with the new one, the operation of the image forming apparatus and the first and second storage devices 2 and 3 (i.e., operation for recovery to the initial state "Q") is carried out according to the following steps.

Typically, after the image forming apparatus detects the replacement of the bottle 1, the developer detector 7*c* detects the presence of developer before the developer detector 7*b* detects the absence of developer. Then, the image forming apparatus returns to its normal state where it operates in a normal manner. When the supply of developer from the first storage device 3 to the second storage device 2 is carried out until the developer detector 7*a* detects the presence of developer, the image forming apparatus completely returns to the initial state "Q".

However, during the replacement of the bottle 1, if, for example, the user repeatedly inserts an empty bottle by mistake, the above-described Timeout 1 and Timeout 2 repeatedly occur. In such a case, the image forming apparatus performs the steps illustrated in FIG. 7.

Figure 7:
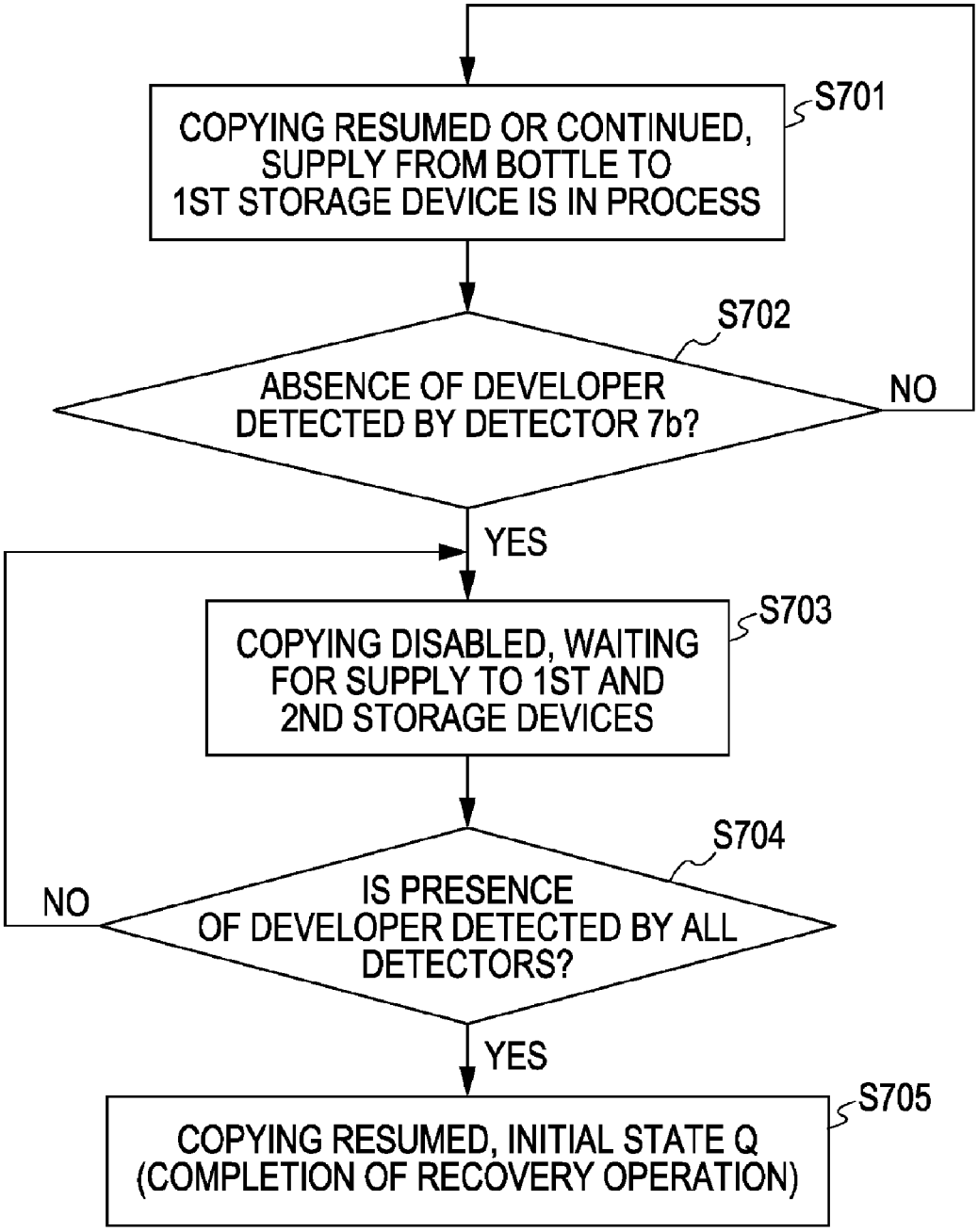
FIG. 7 is another flowchart illustrating exemplary supply control of the supply system according to the exemplary embodiments of the present invention.
Figure 8:
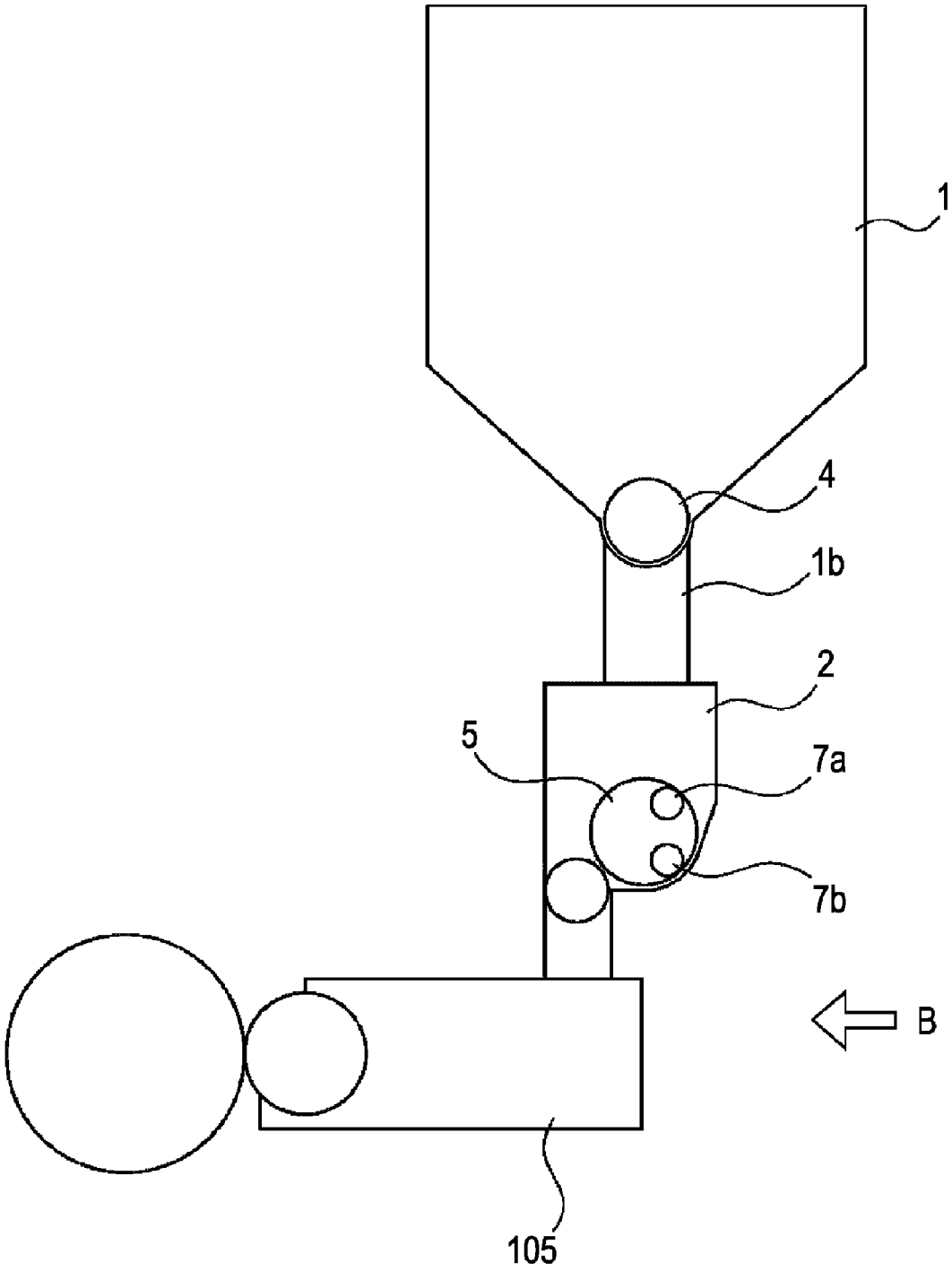
FIG. 8 PRIOR ART
FIG. 8 is a vertical cross-sectional view illustrating a supply system and a developing device according to the related art.
Figure 9:
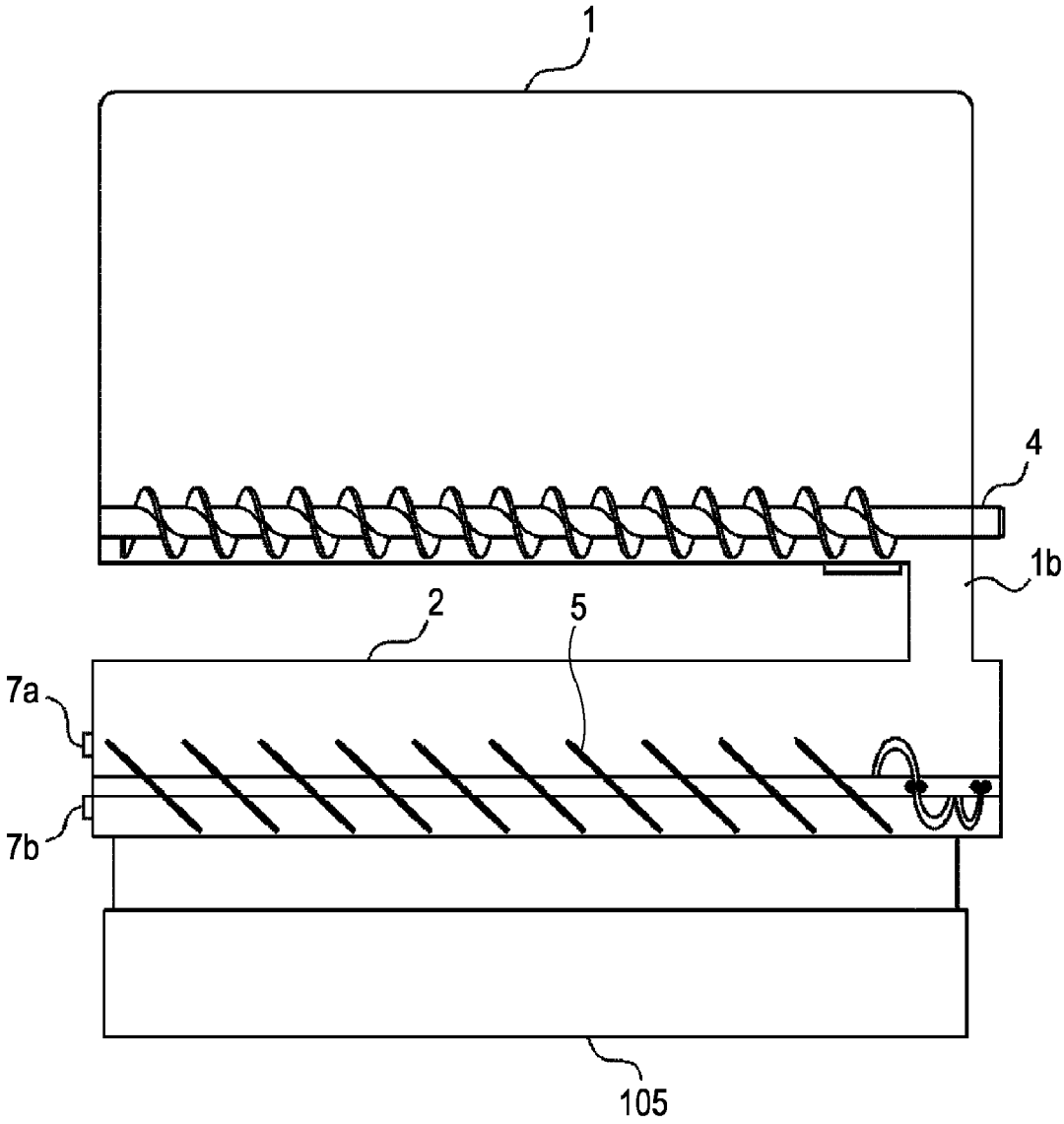
FIG. 9 PRIOR ART
FIG. 9 is a horizontal cross-sectional view illustrating the supply system and the developing device according to the related art.

Referring to FIG. 7, after the bottle 1 is replaced and copying (image formation) is resumed (step S701), if the developer detector 7*b* detects the absence of developer (step S702), the image forming apparatus enters a "copying (image formation) disabled" and "supply wait" state (step S703). In the supply wait state, developer is supplied to the second storage device 2 and first storage device 3. If all the developer detectors 7*a*, 7*b*, and 7*c* detect the presence of developer (step S704), copying (image formation) is resumed and the recovery to the initial state "Q" is completed (step S705).

Since the developer detector 7*b* is thus capable of consistently detecting the presence of developer in the second storage device 2, developer from the second storage device 2 is consistently distributed evenly across the length of the developing device 105.

It is thus possible to provide an image forming apparatus which is capable of eliminating or at least reducing an amount of waiting time associated with a replacement of the bottle 1 (e.g., developer container) by the user, and can ensure highly efficient and stable image formation.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2005-251657 filed Aug. 31, 2005, which is hereby incorporated by reference herein in its entirety.

What is claimed is:

1. An image forming apparatus comprising:

a developing device configured to develop an electrostatic image on an image carrier with developer;

a developer container attachable to and detachable from the image forming apparatus and configured to store developer to be supplied to the developing device;

a developer supply unit configured to transport the developer from the developer container to the developing device;

a developer detector configured to detect an amount of developer in the developer supply unit;

a supply controller configured to control the developer supply unit based on a detection result obtained from the developer detector;

a disabling device configured to disable image formation based on the detection result obtained from the developer detector;

a container replacement detector configured to detect a replacement of the developer container; and a canceling device configured to cancel, after the disabling device disables the image formation, the disabled image formation when the container replacement detector detects a completion of the replacement of the developer container, regardless of the detection result obtained from the developer detector, wherein the developer detector determines whether developer is present at a first predetermined position in the developer supply unit, and the supply controller controls the developer supply unit, when an absence of developer has been detected at the first predetermined position, such that developer is supplied from the developer container to the developer supply unit, wherein the developer detector determines whether, in the developer supply unit, developer is present at a second predetermined position downstream of the first predetermined position in a developer transporting direction, and the disabling device disables the image formation when the developer detector determines that developer is not present at the second predetermined position continuously for more than a predetermined time period.

2. The image forming apparatus according to claim 1, wherein when the developer detector detects that the amount of developer in the developer supply unit has fallen below a first predetermined level, the supply controller controls the developer supply unit such that developer is supplied from the developer container to the developer supply unit.

3. The image forming apparatus according to claim 2, further comprising an informing unit configured to inform that developer in the developer container has been exhausted, when the developer detector detects that the amount of developer in the developer supply unit continues to be below the first predetermined level for more than a predetermined time period.

4. The image forming apparatus according to claim 2, wherein the disabling device disables the image formation when the developer detector detects that the amount of developer in the developer supply unit continues to be below a second predetermined level that is less than the first predetermined level for more than a predetermined time period.

5. The image forming apparatus according to claim 1, further comprising an informing unit configured to inform that developer in the developer container has been exhausted when the developer detector determines that developer is not present at the first predetermined position continuously for more than a predetermined time period.

6. The image forming apparatus according to claim 1, wherein after the canceling device cancels the disabled image formation, the disabling device disables the image formation again based on the detection result obtained from the developer detector.

7. The image forming apparatus according to claim 4, wherein after the canceling device cancels the disabled image formation, the disabling device disables the image formation again when the developer detector detects that the amount of developer in the developer supply unit has fallen below a third predetermined level that is less than the second predetermined level.

8. The image forming apparatus according to claim 1, wherein after the canceling device cancels the disabled image formation, the disabling device disables the image formation again when the developer detector detects that, in the developer supply unit, no developer is present at a third predetermined position downstream of the second predetermined position in the transporting direction.

9. An apparatus comprising:

a toner container detachably attachable to an image forming apparatus the toner container to store toner to be supplied to a developing device;

a toner supply unit to transport the toner from the toner container to the developing device, the toner supply unit controlled based on an amount of toner present in the toner supply unit; and a controller to disable image formation of the image forming apparatus based on the amount of toner present in the toner supply unit, wherein, after the controller has disabled the image formation based on the amount of toner present in the toner supply unit, if an occurrence of a replacement of the toner container is recognized, the controller enables the image formation, wherein when a detector detects that toner is not present at a first position in the toner supply unit, the toner supply unit transports toner from the toner container to the toner supply unit, and wherein the detector determines whether, in the toner supply unit, toner is present at a second position downstream of the first position in a toner transporting direction, and the controller disables the image formation when the detector determines that toner is not present at the second position continuously for more than a threshold time period.

10. The apparatus according to claim 9, wherein the developing device is capable of developing electrostatic image on an image carrier using the toner.

11. The apparatus according to claim 9, further comprising:

a container detector to detect whether or not the toner container is currently attached to the image forming apparatus, wherein the controller recognizes the occurrence of the replacement of the toner container based on a detection signal generated by the container detector.

12. The apparatus according to claim 9, wherein the replacement of the toner container is recognized by detecting that the toner container has been removed from the image forming apparatus and subsequently detecting that a toner container has been attached to image forming apparatus.

13. The apparatus according to claim 9, wherein when a detector detects that an amount of toner in the toner supply unit is below a first level, the toner supply unit transports toner from the toner container to the toner supply unit.

14. The apparatus according to claim 13, wherein the controller disables the image formation when the detector detects that the amount of toner in the toner supply unit continues to be below a second level that is less than the first level for more than a threshold time period.

* * * * *